US006575108B1

(12) United States Patent
Lindström

(10) Patent No.: US 6,575,108 B1
(45) Date of Patent: Jun. 10, 2003

(54) MAST TRACK SLIDE FOR A SAIL

(75) Inventor: Mathias Lindström, Göteborg (SE)

(73) Assignee: Sélden Mast AB (SE)

( * ) Notice: Subject to any disclaimer, the term of this patent is extended or adjusted under 35 U.S.C. 154(b) by 0 days.

(21) Appl. No.: 09/957,914

(22) Filed: Sep. 21, 2001

(51) Int. Cl.[7] ..... B63H 9/04
(52) U.S. Cl. ..... 114/108; 114/98; 114/112
(58) Field of Search ..... 114/112, 108, 114/98

(56) References Cited

U.S. PATENT DOCUMENTS 5,191,851 A * 3/1993 Rutgerson ..... 114/102.25
5,787,830 A 8/1998 Frederiksen

FOREIGN PATENT DOCUMENTS

WO 9841446 9/1998

* cited by examiner

*Primary Examiner*—Jesus D. Sotelo
(74) *Attorney, Agent, or Firm*—Orum & Roth

(57) ABSTRACT

An arrangement for a sail for sailing boats to connect the sail to a mast (4) on the sailing boat by means of a number of mast track slides (6) distributed along one edge of the sail, which are so arranged as to be connected by means of rolling devices to a track extending along the mast. The rolling devices are accommodated jointly in a channel-shaped track (9) integrated with the mast (4), with the edges (18,19;21, 28;22,29) of which the aforementioned rolling devices are so arranged as to interact. A channel-shaped opening (16) extends along the aforementioned track (9) to permit the track slides (6) to extend out from the aforementioned track (9) with a narrower part for attachment to the sail with a broader part.

20 Claims, 7 Drawing Sheets

MAST TRACK SLIDE FOR A SAIL

The present invention relates to an arrangement for a sail for sailing boats intended to connect the sail to a mast on the sailing boat by means of a number of mast track slides distributed along one edge of the sail, which are so arranged as to be connected by means of rolling devices to a track extending along the mast.

Track slides on board sailing boats for the purpose of hoisting and hauling the mainsail on a mast run in the longitudinal direction of the mast and provide a link between the aft side of the mast and the leading edge of the mainsail. The track slides are attached to the sail with a mutual spacing of ca. 1 metre along the direction of movement and in such a way as to give the lowest possible friction against the mast in order to facilitate hoisting, hauling and reefing the mainsail. Low friction has become increasingly important in view of the fact that modern sails often have a large trailing edge and full-length battens which push against the mast. The track slides also perform the function of gathering up the sail at boom height when the sail is being hauled, so that it does not fall from the mast and the sail can be stowed on the boom.

Previously disclosed systems include: Rope luff; a rope is sewn into the luff of the mainsail. This is fed into a channel on the aft side of the mast. With this old method, the sail is not gathered up as described above, but falls down onto the deck when the sail is hauled. This is one disadvantage. Another disadvantage is that very high friction is produced between the luff and the mast. The advantages are low weight, as no track slides are required, and the absence of a gap between the sail and the mast. The system is rarely encountered today, other than on dinghies and a number of smaller keeled boats intended for racing and on older boats, essentially those with a wooden mast. Sliding track slide;. this runs in a channel on the aft side of the mast and is attached to the mainsail with a shackle or is sewn in position. The advantages are low weight, low price and the fact that, due to the small height of the sliding track slides, the sail takes up minimal space when it is gathered up above the boom during hauling. The disadvantage is high friction. Ball track slide; this moves on a rail mounted on the aft side of the mast. Low friction thanks to circulating plastic balls, made of torlon®, which absorb loads in all directions apart from the direction of movement. Advantage: low friction. Disadvantages: heavy, as a separate aluminium rail must be installed for the entire length of the mast. The track slides also weigh a great deal, since they are made of aluminium. It is also expensive because of the extra rail and the expensive torlon® balls. The balls are flattened under extreme loading, and the balls then crease to roll. Finally, the aforementioned system is highly affected by dirt and salt, as the balls are a close fit and roll against one another.

The track slide for a sail previously disclosed in WO 98/41446 has an attachment part in the track slide that is accommodated internally in a track integrated with the mast. An upper and a lower lateral guide roller are situated in the opening in the track in contact with the edges of the track.

In this previously disclosed solution, the only forces to be absorbed are those with a rolling function in a single direction. A sliding friction is obtained in all other directions. Sliding friction is precisely what it is wished to avoid.

The entire wheel arrangement is thus not accommodated internally in the inner accommodating space of the track, but large parts thereof are situated outside the mast where they are unprotected from the weather and wind.

Previously disclosed in U.S. Pat. No. 5,787,830 A is a ball track slide of the kind referred to in the preamble to the description in the application, although in this case a number of rows of balls run internally in a track inside the mast.

The principal object of the present invention is thus, in the first instance, to attempt to solve the aforementioned problems by simple and effectively functioning means.

The aforementioned object is achieved by means of an arrangement in accordance with the present invention, which is characterized essentially in that the aforementioned rolling devices are accommodated jointly in a channel-shaped track integrated with the mast, with the edges of which the aforementioned rolling devices are so arranged as to interact, in that a channel-shaped opening extends along the aforementioned track to permit the track slides to extend out from the aforementioned track to enable their attachment to the sail, in that the track is formed by a separate section of the rear part of the mast, and in that a vertical flange situated to either side of the opening and extending in a common direction forms a track for central support wheels.

The following features, among others, distinguish the present invention from the arrangement previously disclosed in U.S. Pat. No. 5,787,830 A:

The present invention uses wheels instead of balls with the advantages described in the description.

All the bearing elements are situated internally in the mast in a track, with the advantages that this provides.

Internal flanges absorb the lateral forces, unlike in the prior art, where the lateral forces are absorbed by the edges of the track, which must then be made very thick in order to function in practice.

The present invention operates between two walls, and not around as single wall as in the prior art.

Significant differences thus exist between the invention and the prior art, since no previously disclosed solution exhibits internal tracks for rolling devices in a mast and these permit all the bearing elements for the track slide to be situated internally in a track in the mast, rather than being located outside the mast together with the whole or half of the track slide. The rolling friction is now minimal, which facilitates handling of the sail on board the vessel.

The invention is described below as a preferred illustrative embodiment with reference to the accompanying drawings, in which FIG. 1 shows an upper part of a sailing boat mast with the invent on applied thereto;

Figure 1:
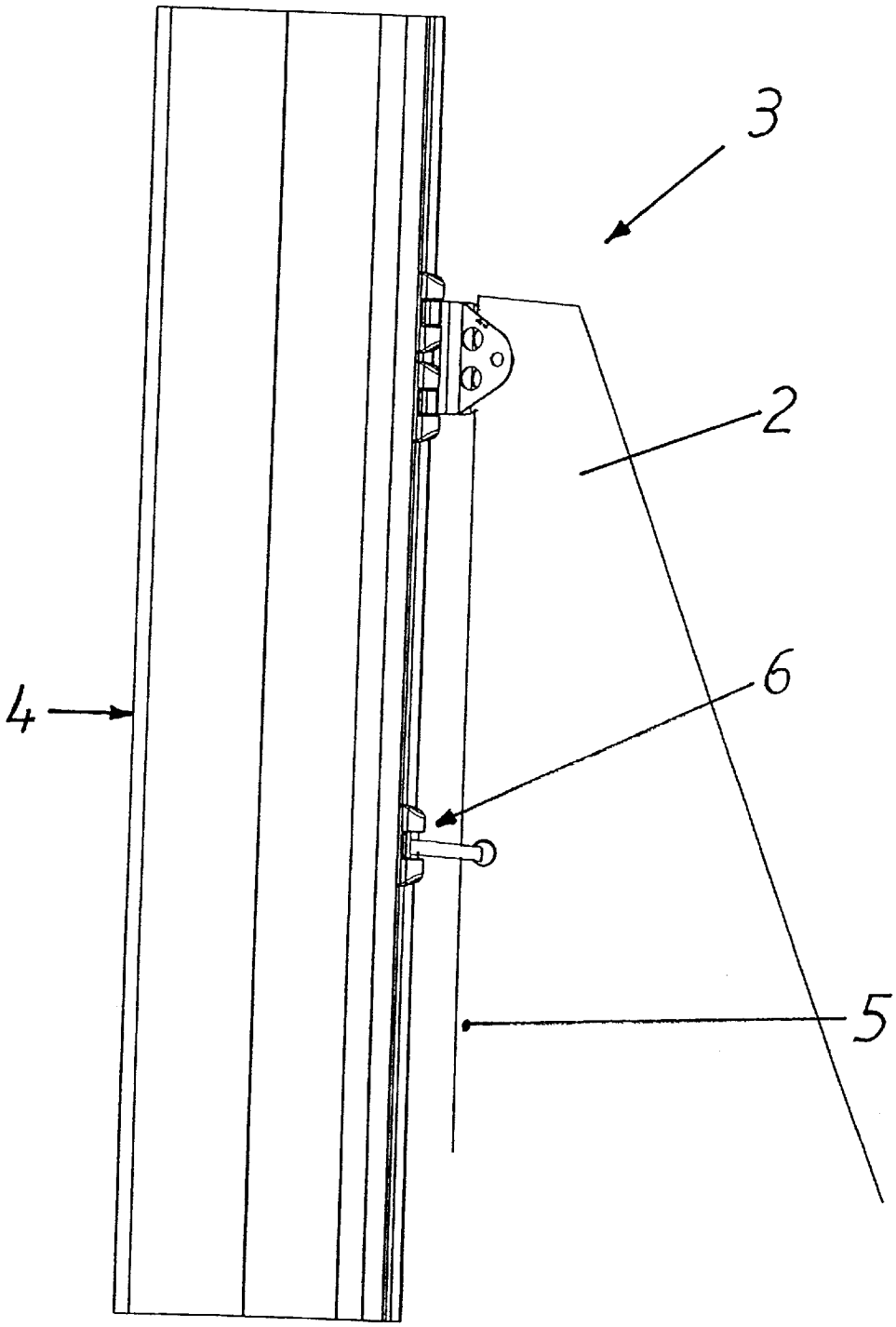

An arrangement 1 for a sail 2 for a sailing boat 3 intended to connect the sail 2 to a mast 4 on the sailing boat 3 in question by means of a number of track slides 6 distributed along one edge 5 of the sail, which track slides 6 are so arranged as to be connected by means of rolling devices 8, 24 to a track 9 extending along the mast 4, in accordance with the present invention has the aforementioned rolling devices 8, 24 so arranged as to be accommodated jointly in a channel-shaped track 9 integrated with the mast 4.

The aforementioned rolling devices 8, 24 are so arranged as to interact with edges 10, 11, 12, 13; 14, 15 on the aforementioned track 9.

A channel-shaped opening 16 extends along the aforementioned track 9 to permit the track slides 6 to extend out from the aforementioned track 9 for connection with the sail 2 in question.

Figure 2:
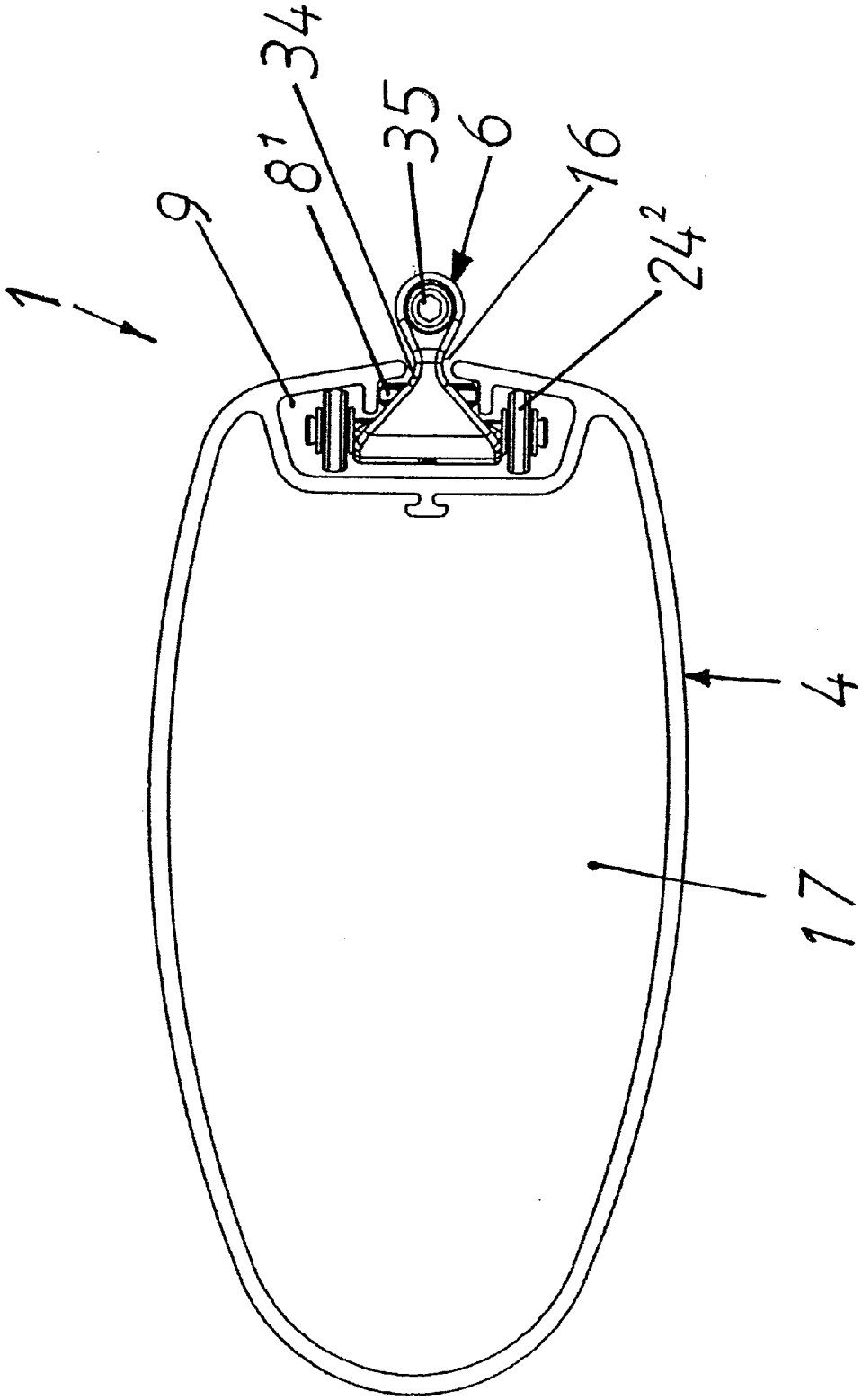
FIG. 2 shows a cross section through the mast with a wheeled track slide accommodated therein.
Figure 3:
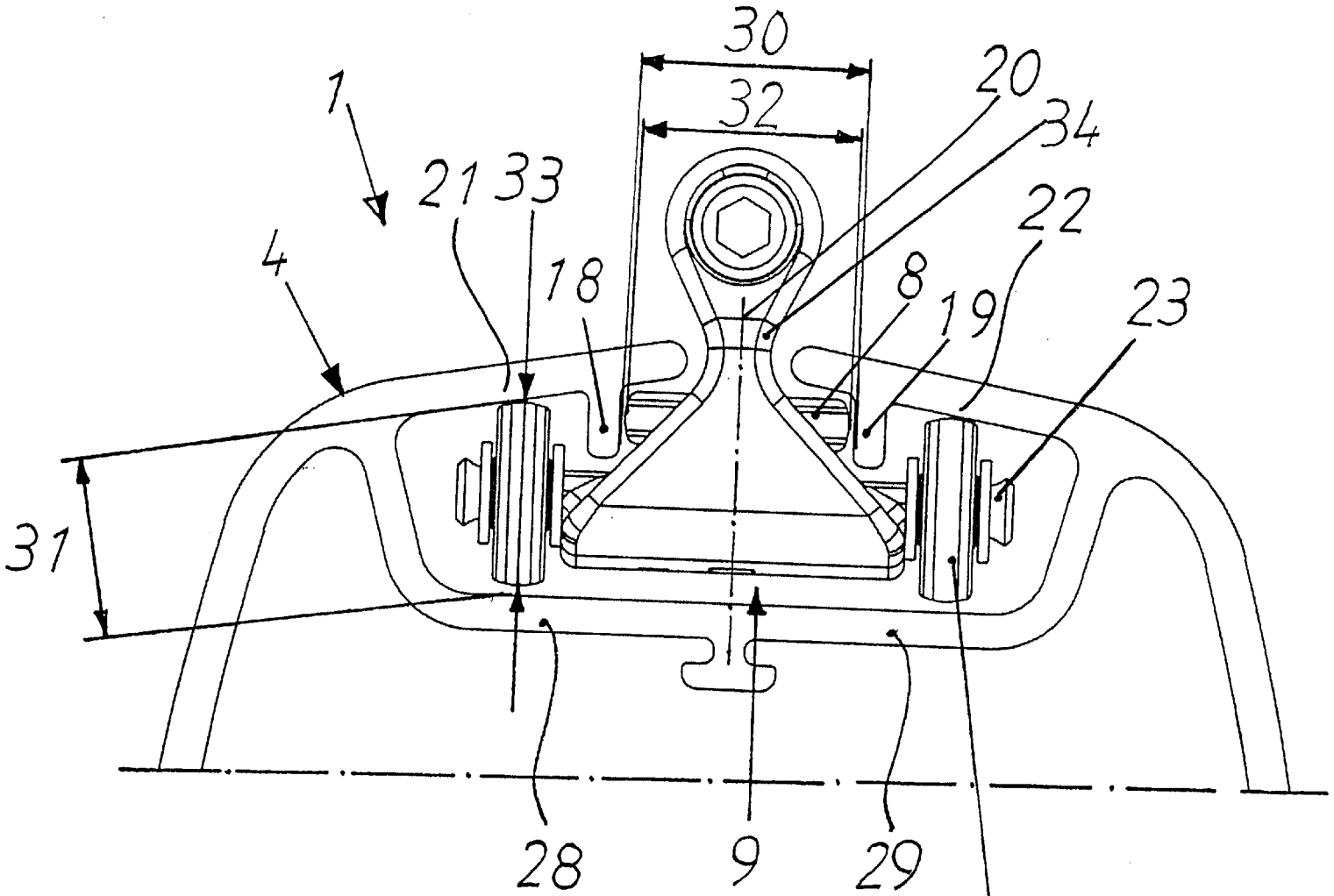
FIG. 3 shows the aforementioned wheeled track slide on a larger scale.
Figure 4:
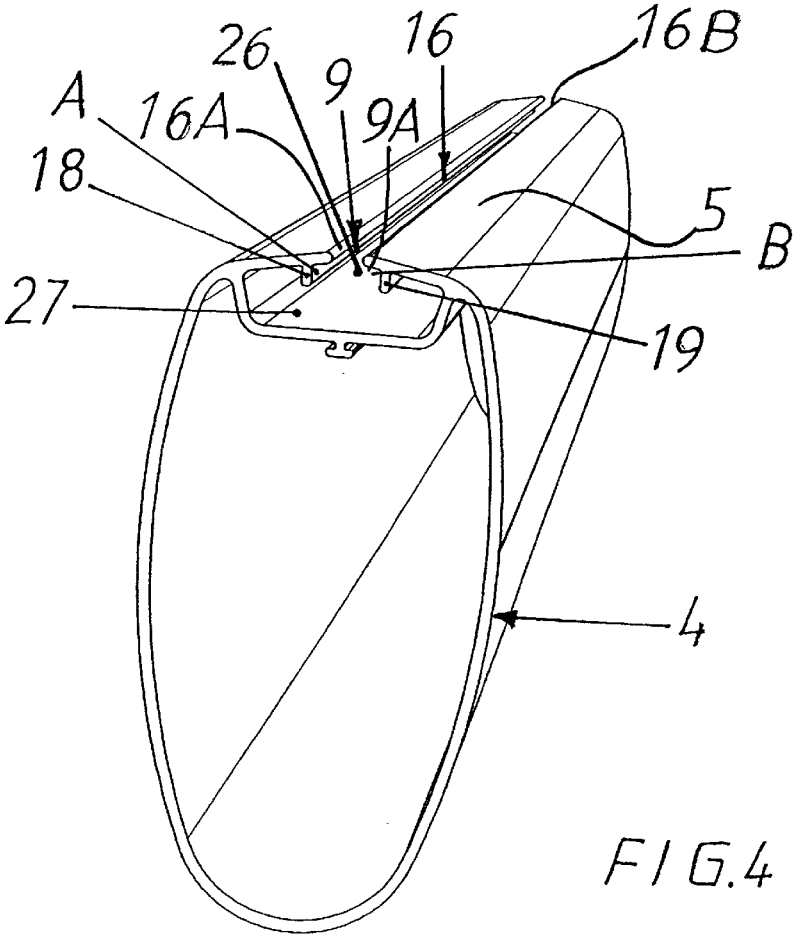
FIGS. 4 and 5 show a perspective view and a cross section of a sailing boat mast with a space to accommodate a wheeled track slide therein.
Figure 5:
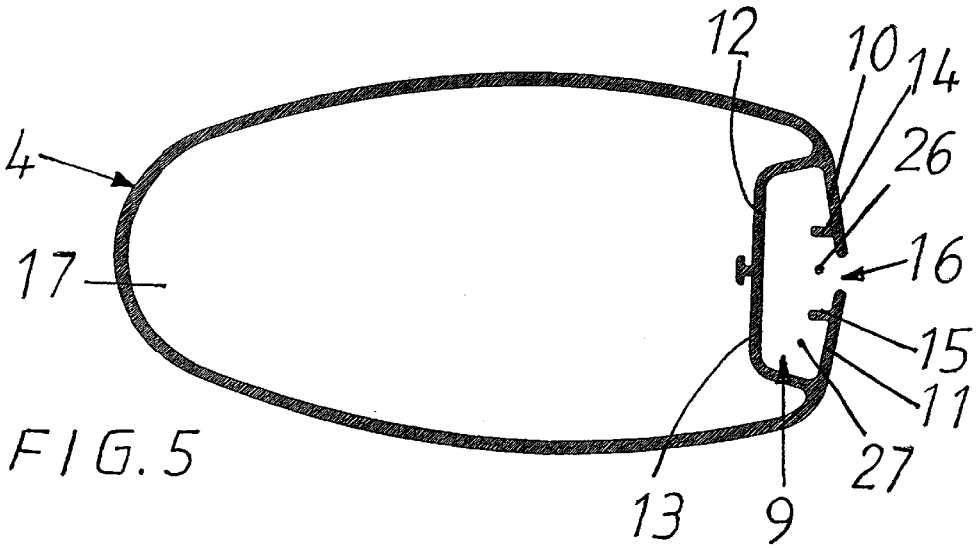
Figure 6:
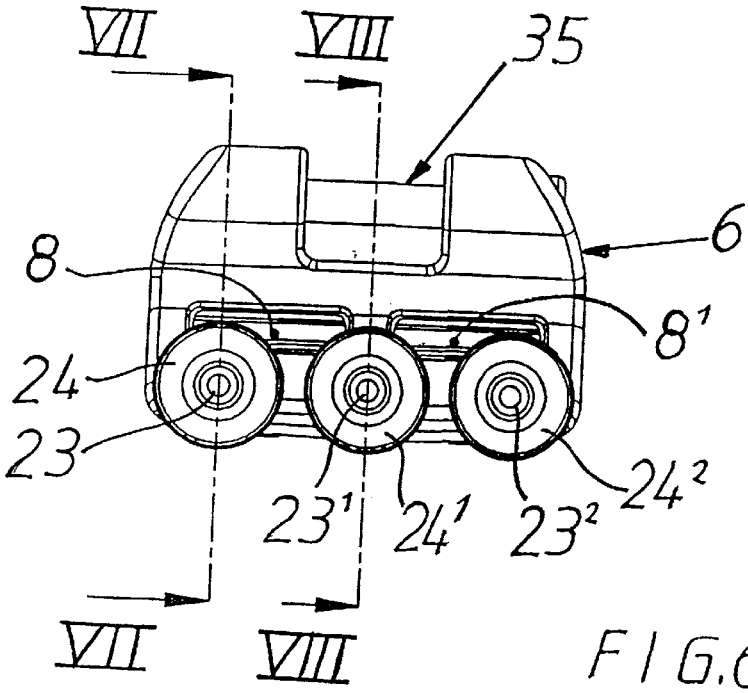
FIG. 6 shows a wheeled track slide viewed directly from the side.
Figure 7:
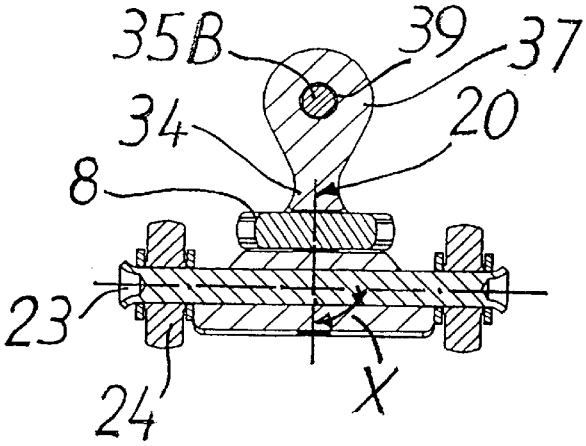
FIGS. 7 and 8 show sectional views along the lines VII—VII and VIII—VIII in FIG. 6.
Figure 8:
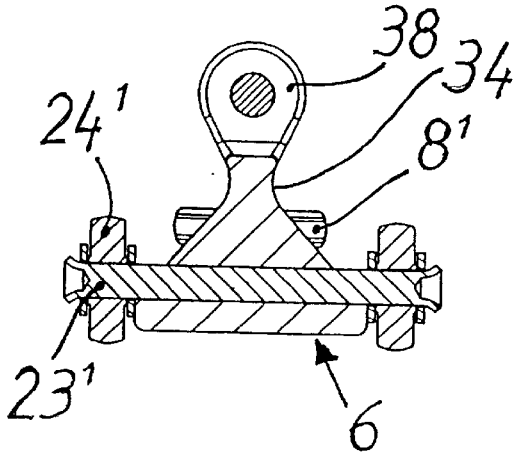
Figure 11:
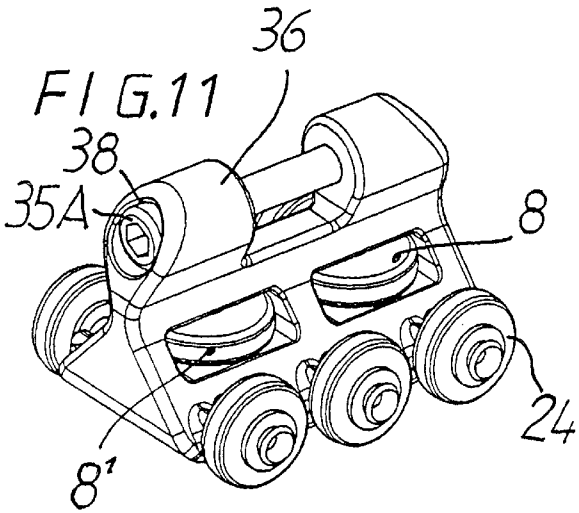
FIGS. 9–12 show the wheeled track slide viewed from different directions, i.e. at an angle from the front, from below with its front side shown, at an angle from behind, and from below with its rear side shown.
Figure 12:
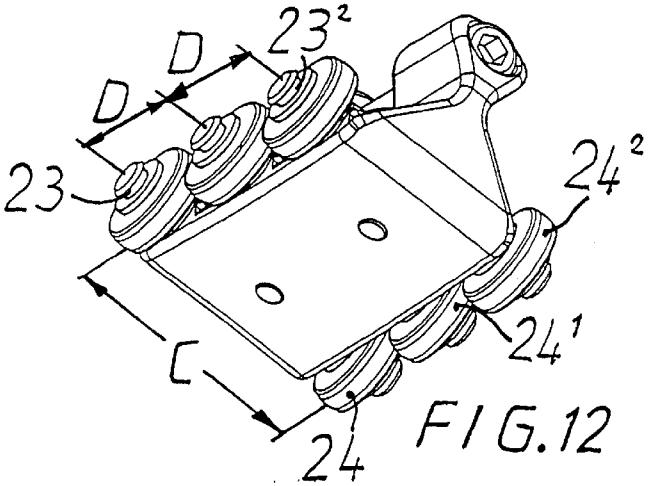
Figure 9:
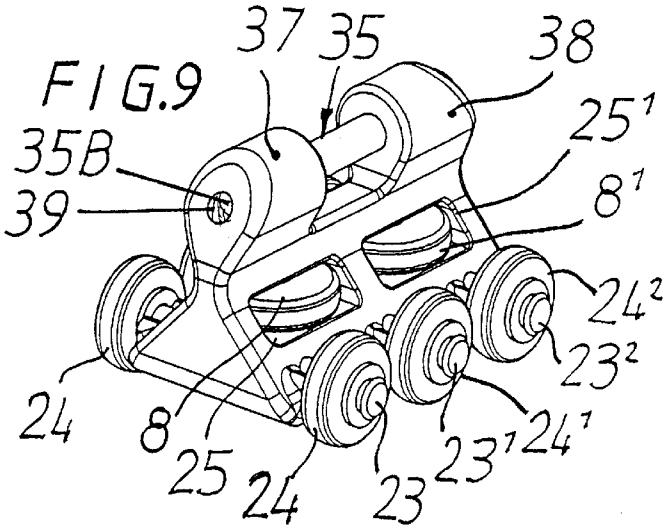
Figure 10:
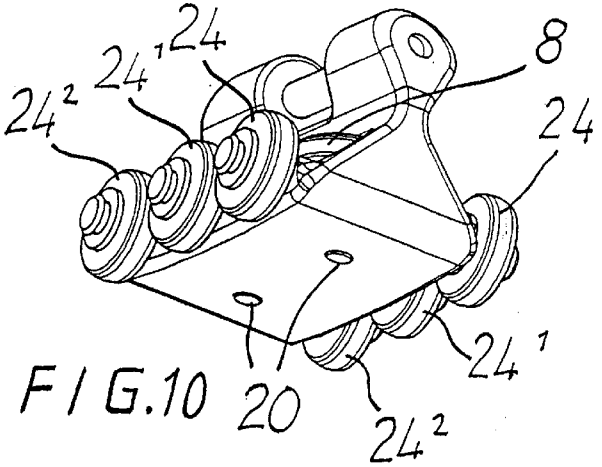
Figure 13:
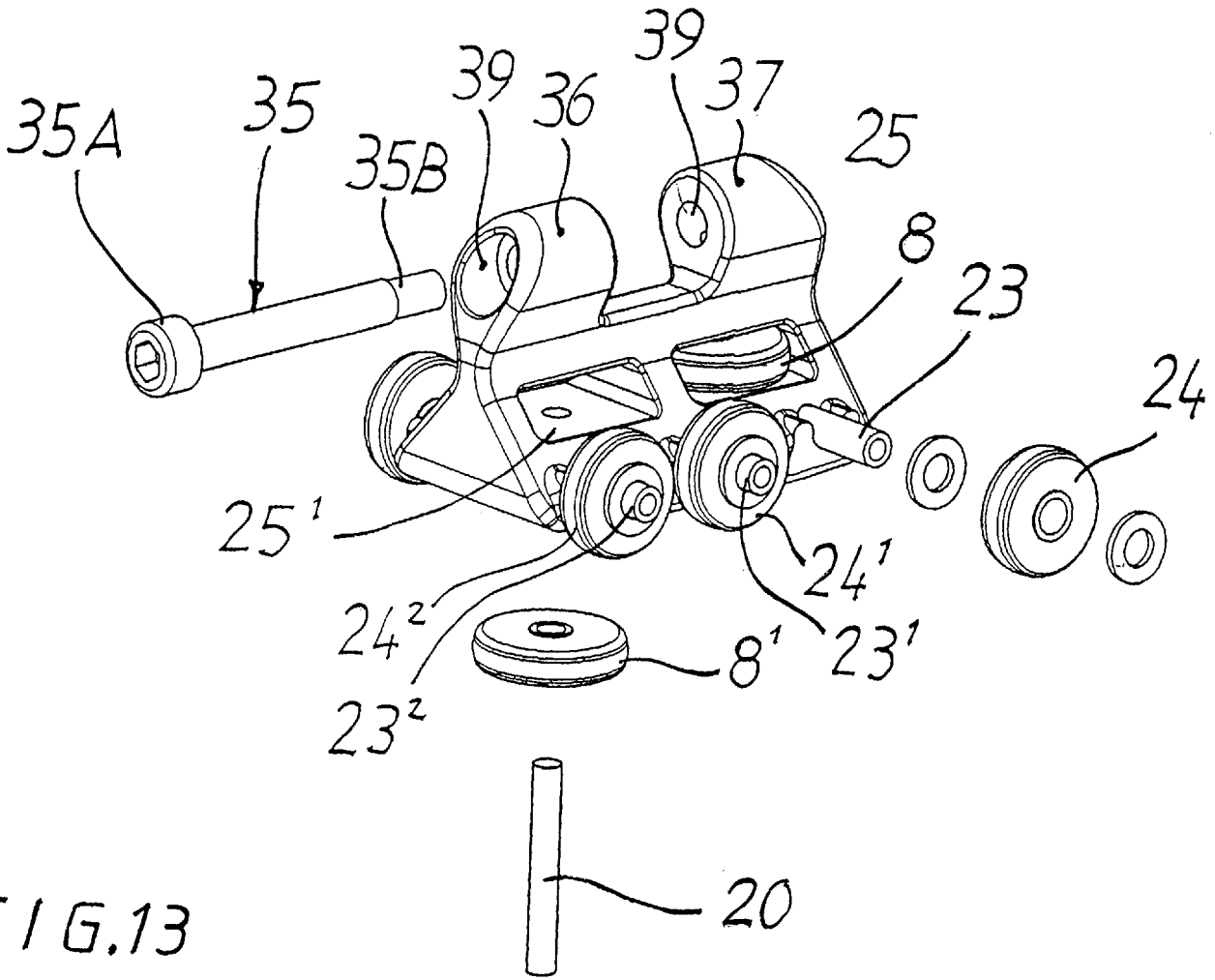
FIG. 13 shows an exploded view of the wheeled track slide.

As can be clearly seen from the drawings in question, and in particular FIGS. 2, 4 and 5, the track 9 in the track profile made of a metal such as aluminium with an open internal space 17 is in the form of a separate section of the part of the mast situated at the rear and integrated with the mast 4. In this way, a vertical flange 18, 19 situated to either side A, B of the channel-shaped and slot-shaped narrow opening 16 forms a track 9A with its respective edge surfaces 14, 15 for a central supporting wheel 8, 8$^1$ rotatably mounted about a horizontal rotation axle 20.

The embodiment shown here exhibits two central supporting wheels 8, 8$^1$, although the number can be freely selected in accordance with the space available and the level of the forces to be absorbed.

The aforementioned vertical flanges 18, 19 situated to either side A, B of the opening 16 in the mast 4 extend essentially parallel with one another.

Arranged outside each of the parallel vertical flanges 18, 19 are lateral flanges 21, 22, which extend in the longitudinal direction of the mast either perpendicularly outwards from the aforementioned flanges 18, 19 or, as in accordance with the illustrative embodiment shown, in such a way that they are inclined in a direction outwards from the aforementioned centrally located channel-shaped mast opening 16. In conjunction with this, a number of bearing axles 20; 23, 23$^1$, 23$^2$ mutually intersecting at a right angle X to one another are so arranged as to support rotatably mounted wheels 8, 8$^1$; 24, 24$^1$, 24$^2$. The aforementioned wheels 8, 8$^1$; 24, 24$^1$, 24$^2$ are each supported singly and in pairs by their own axle 20; 23, 23$^1$, 23$^2$ and are so arranged as to be capable of running each against its own track surface 10–15.

In the illustrative embodiment shown here, pairs of lateral supporting wheels 24, 24$^1$, 24$^2$ are so arranged as to be supported each by its own horizontal bearing axle 23, 23$^1$, 23$^2$ at a mutual distance C, D from one another.

In an area 25, 25$^1$ situated between pairs of parallel horizontal bearing axles 23, 23$^1$; 23$^1$, 23$^2$ for lateral supporting wheels 24, 24$^1$, 24$^2$, a transverse central guide wheel 8, 8$^1$ is rotatably mounted on a axle 20 extending perpendicularly to the axles 23, 23$^1$, 23$^2$ of the aforementioned pairs of parallel horizontally rotating longitudinal lateral supporting wheels 24, 24$^1$, 24$^2$.

Preferably at least two transverse central guide wheels 8, 8$^1$ are supported on bearings in the area between their own group of pairs of parallel horizontal bearing axles 23, 23$^1$; 23$^1$–23$^2$.

The aforementioned central guide wheels 8, 8$^1$ and lateral supporting wheels 24, 24$^1$, 24$^2$ are thus each so arranged as to run in a mutually separate section 26, 27 in the track 9 formed between pairs of track surfaces 18, 19, and 21, 28 and 22, 29 respectively. The aforementioned track surfaces are situated at a mutual distance 30, 31 from one another, which distance slightly exceeds the effective running diameter of the associated wheels.

Fixed parts of the track slide 6 may consist of plastic and/or metal material or some other suitable material, such as ceramics.

The wheeled track slide is preferably manufactured in plastic with plastic wheels which run on steel axles. The track slide absorbs loads in all directions inside the mast in a space adapted for the track slide. The special arrangement of the wheels on the track slide means that all loads are absorbed by the wheels in such a way that low friction is generated even at high loads. A narrow part 34 of the track slide 6 projects out through the track 16 on the aft side of the mast 4. This part can be attached to the mainsail in a variety of ways, for example by means of a transcurrent bolt 35 which is accommodated at its respective ends 35A, 35B in an associated supporting lug 36, 37 in a transcurrent hole 38 and in a threaded hole 39. The track 16 in the mast 4 is broader than in conventional masts in order to prevent the neck 34 of the track slide, which for reasons of strength must exhibit a certain width, from dragging against the edges 16A, 16B of the track, and to ensure that all contact takes place between the mast and the wheels of the track slide.

Novelty

- Absorption of forces by roller bearings in all directions other than in the direction of movement entirely inside the mast profile.
- The design of the mast profile is specially adapted for the track slide, so that all forces are absorbed by the wheels of the track slide inside the mast.
- The opening is made broader to prevent the track slide from sliding against the edges of the track, thereby generating undesired friction.

Advantages

- Less affected by dirt than ball track slides. On the one hand because there are fewer wheels, and the diameter of the wheels is greater compared with that of balls, and on the other hand because the wheels do not have any mutual contact with one another. In addition, the whole of the rolling mechanism lies inside the mast, where it is less exposed to external influences.
- There is no need to install a rail, which gives low weight, a lower price and does not require any additional installation work if a change is made, for example from a sliding track slide to a wheeled track slide The function of the invention will have been appreciated from the foregoing, and the invention is not restricted to what is described above and illustrated in the drawings

What is claimed is:

1. Arrangement (1) for a sail (2) for a sailing boat (3) intended to connect the sail (2) to a mast (4) on the sailing boat (3) by means of a number of track slides (6) distributed along one edge (5) of the sail, which are arranged to be connected by rolling devices (8, 24) to a track (9) extending along the mast (4) wherein: the rolling devices (8, 24) are accommodated jointly in a channel-shaped track (9) integrated with the mast (4), with edges (10–15) of which the rolling devices (8, 24) are arranged to interact, in a channel-shaped opening (16) extending along the track (9) to permit the track slides (6) to extend out from the sail (2); the track (9) is formed by a separate section of a rear part of the mast, and a vertical flange (18, 19) situated to either side (A, B) of the channel-shaped opening (16) and extending in a common direction forms a track surface (9A) for at least one central support wheel (8, 8$^1$).

2. Arrangement in accordance with claim 1, wherein the vertical flanges (18, 19) situated to either side (A, B) of the channel-shaped opening (16) in the mast (4) extend essentially parallel with one another.

3. Arrangement in accordance with claim 2, wherein arranged outside each of the vertical flanges (18, 19) are lateral flanges (21, 22), which extend one of perpendicularly outwards from the aforementioned flanges (18, 19) and inclined in a direction outwards from the mast opening (16).

4. Arrangement in accordance with claim 2, wherein fixed parts of the track slide (6) consist of one of plastic and metal material.

5. Arrangement in accordance with claim 2, wherein each of the support wheels (8, $8^1$) is rotatably mounted about a horizontal rotation axle (20).

6. Arrangement in accordance with claim 2 wherein the rolling devices include bearing axles which intersect a horizontal rotation axle of said central supporting wheel at a right angle and are so arranged to support wheels, said wheels are so arranged as to run each against its own track surface.

7. Arrangement in accordance with claim 2, wherein central guide wheels and lateral supporting wheels are each so arranged as to run in a mutually separate section in said track formed in the mast between pairs of track surfaces, which are situated at mutual distance from one another, which distance slightly exceeds the effective running diameter of the associated wheels.

8. Arrangement in accordance with claim 1, wherein arranged outside each of the vertical flanges (18, 19) are lateral flanges (21, 22), which extend one of perpendicularly outwards from the aforementioned flanges (18, 19) and inclined in a direction outwards from the mast opening (16).

9. Arrangement in accordance with claim 8, wherein fixed parts of the track slide (6) consist of one of plastic and metal material.

10. Arrangement in accordance with claim 8, wherein each of the support wheels (8, 81) is rotatably mounted about a horizontal rotation axle (20).

11. Arrangement in accordance with claim 3 wherein the rolling devices include bearing axles which intersect a horizontal rotation axle of said central supporting wheel at a right angle and are so arranged to support wheels, said wheels are so arranged as to run each against its own track surface.

12. Arrangement in accordance with claim 8, wherein central guide wheels and lateral supporting wheels are each so arranged as to run in a mutually separate section in said track formed in the mast between pairs of track surfaces, which are situated at a mutual distance from one another, which distance slightly exceeds the running diameter of the associated wheels.

13. Arrangement in accordance with claim 1 wherein the rolling devices include bearing axles which intersect a horizontal rotation axle of said central supporting wheel at a right angle and are so arranged to support wheels, said wheels are so arranged as to run each against its own track surface.

14. Arrangement in accordance with claim 13, wherein pairs of lateral supporting wheels are each supported by their own horizontal bearing axle.

15. Arrangement in accordance with claim 14, wherein in an area situated between pairs of the horizontal bearing axles for lateral supporting wheels a central support wheel is rotatably mounted on a vertical axis extending perpendicularly to the horizontal bearing axles of the pairs of lateral supporting wheels.

16. Arrangement in accordance with claim 15, wherein two transverse central guide wheels are supporting on bearings in the area between their own group of horizontal bearing axles.

17. Arrangement in accordance 13, wherein fixed parts of the tracks slide consist of one of plastic and metal material.

18. Arrangement in accordance with claim 1, wherein fixed parts of the track slide (6) consist of one of plastic and metal material.

19. Arrangement in accordance with claim 1, wherein said rolling devices includes the central supporting wheels (8,$8^1$) and lateral supporting wheels (8, $8^1$); said central supporting wheels (24, $24^1$, $24^2$) are each arranged to run in a mutually separate section (26, 27) in the track (9) formed in the mast (4) between pairs of track surfaces (18, 19; 21, 28; 22, 29), situated at a mutual distance (30;31) from one another, which distance exceeds an effective running diameter (32; 33) of the support wheels.

20. Arrangement in accordance with claim 1, wherein each of the support wheels (8, 81) is rotatably mounted about a horizontal rotation axle (20).

* * * * *